United States Patent [19]

Smith et al.

[11] Patent Number: 4,596,989

[45] Date of Patent: Jun. 24, 1986

[54] STABILIZED ANTENNA SYSTEM HAVING AN ACCELERATION DISPLACEABLE MASS

[75] Inventors: Dorsey T. Smith; Albert H. Bieser, both of Garland, Tex.

[73] Assignee: Tracor BEI, Inc., Austin, Tex.

[21] Appl. No.: 544,445

[22] Filed: Oct. 21, 1983

Related U.S. Application Data

[63] Continuation-in-part of Ser. No. 466,222, Feb. 14, 1983, abandoned.

[51] Int. Cl.[4] ..... H01Q 1/18

[52] U.S. Cl. ..... 343/709; 343/765; 33/321

[58] Field of Search ..... 343/709, 710, 765, 766, 343/716; 33/318, 321; 248/182

[56] References Cited

U.S. PATENT DOCUMENTS

| | | | |
|---|---|---|---|
| 1,310,862 | 7/1919 | Gray et al. . | |
| 1,573,343 | 2/1926 | Holeka . | |
| 2,199,294 | 4/1940 | Seligmann | 33/204 |
| 3,860,931 | 1/1975 | Pope et al. | 343/709 |
| 3,893,123 | 7/1975 | Bieser | 343/706 |
| 3,968,496 | 7/1976 | Brunvoll | 343/765 |
| 4,020,491 | 4/1977 | Bieser et al. | 343/765 |
| 4,442,435 | 4/1984 | Kiryu et al. | 343/709 |

OTHER PUBLICATIONS

"Direct Mechanical Stabilization of Mobile Microwave Antenna", R. J. Matthews, Apr. 1980.

"Marine Stabilized Antenna Pedestal System Model 5080", SeaTel, Inc.

*Primary Examiner*—Eli Lieberman

*Attorney, Agent, or Firm*—Arnold, White & Durkee

[57] ABSTRACT

A stabilized antenna system is disclosed. The stabilized antenna platform includes an acceleration displaceable mass which compensates for linear acceleration forces to inhibit tipping of the antenna platform. The stabilized antenna system may include in combination a gimbal mounting and one or more gyros.

49 Claims, 13 Drawing Figures

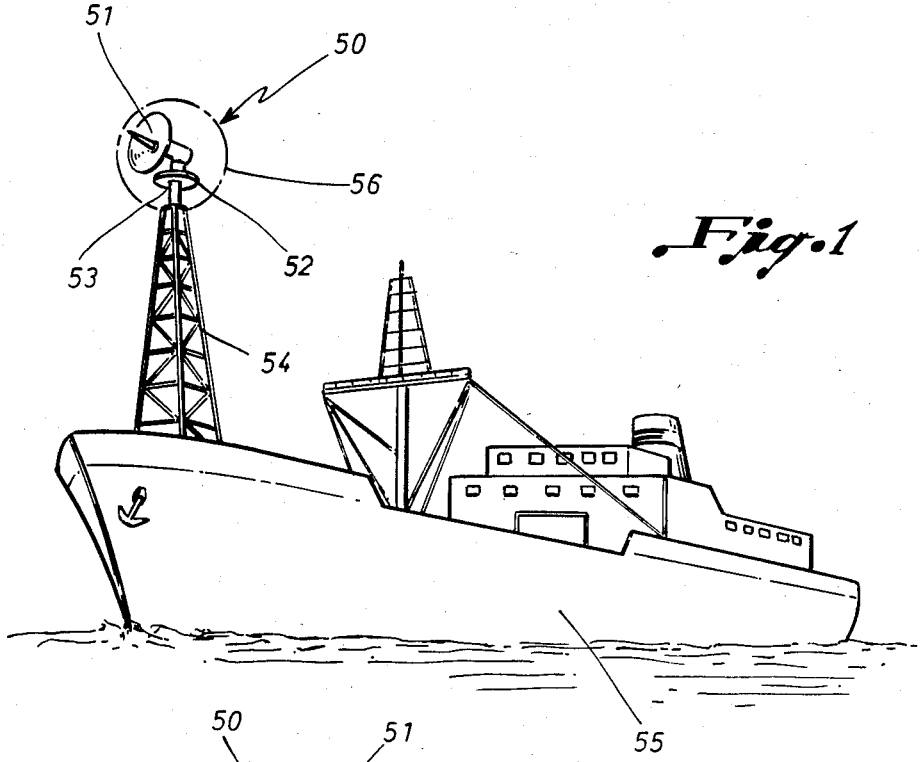
Fig. 1
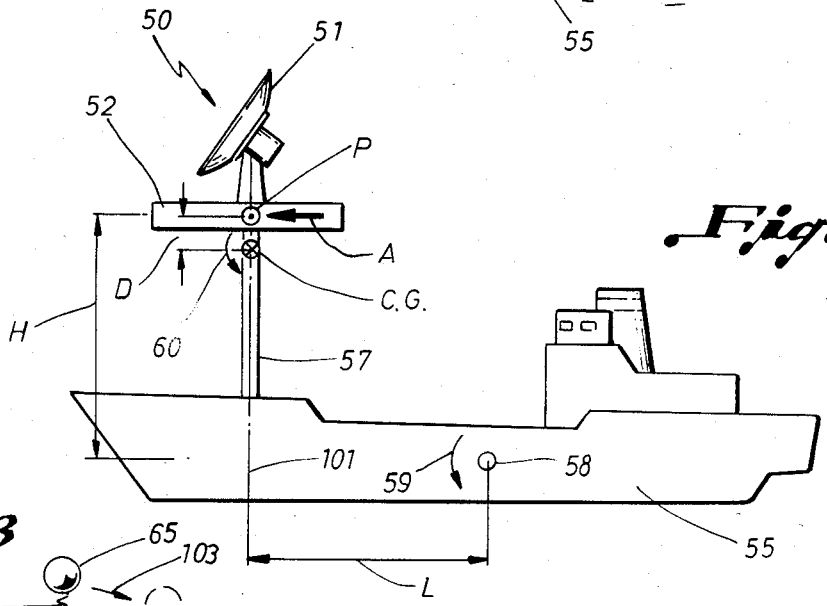
Fig. 2
Fig. 3
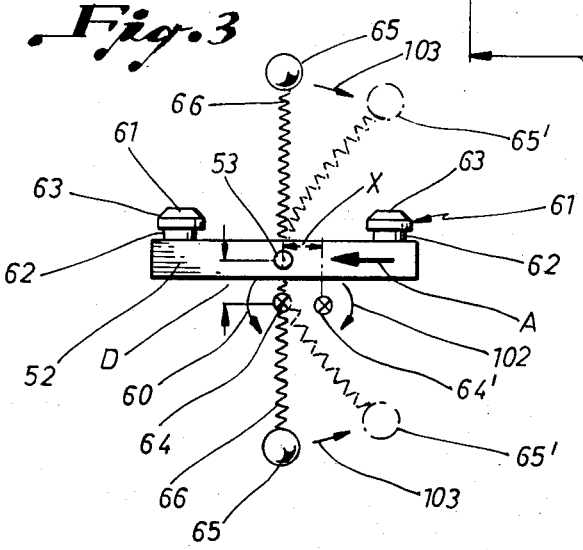
Fig. 4
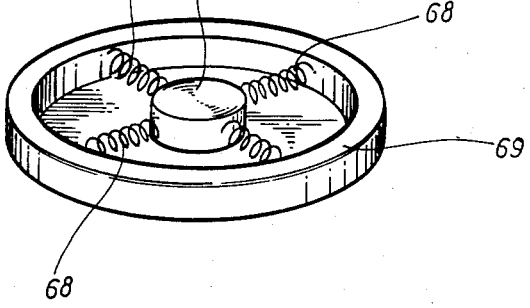

Fig. 9
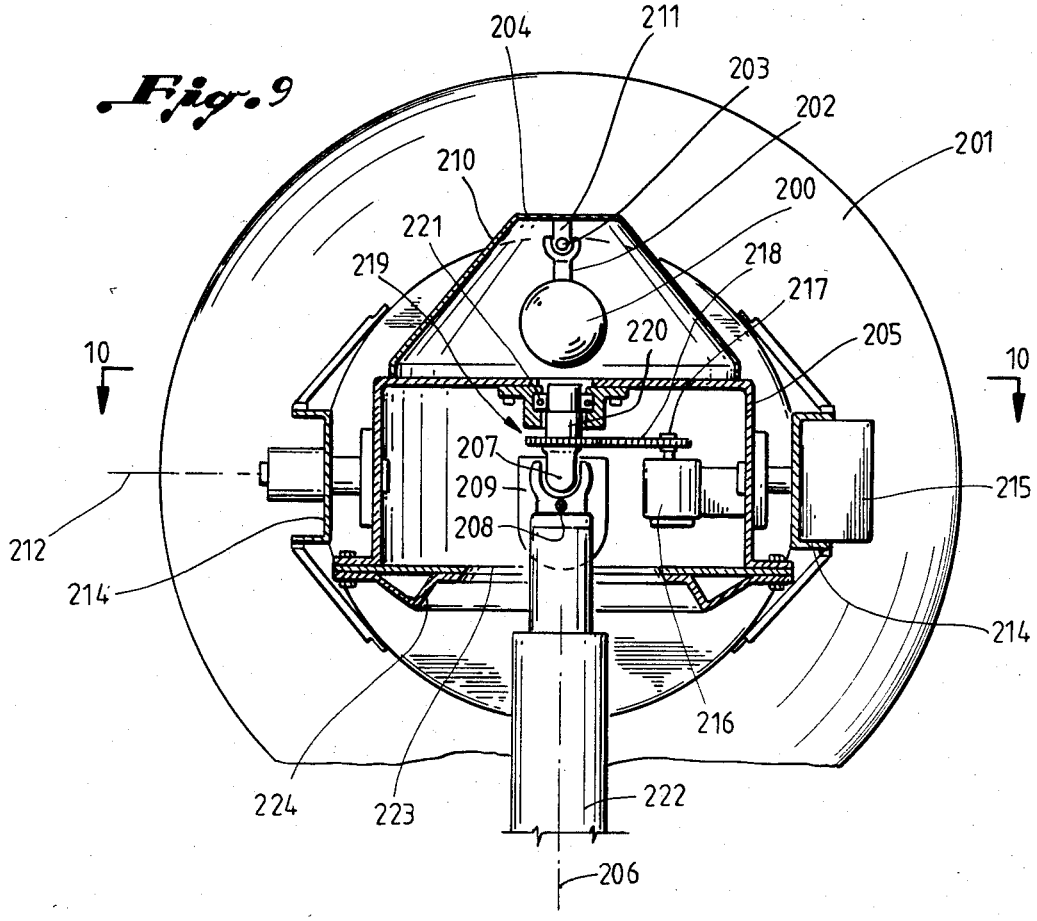
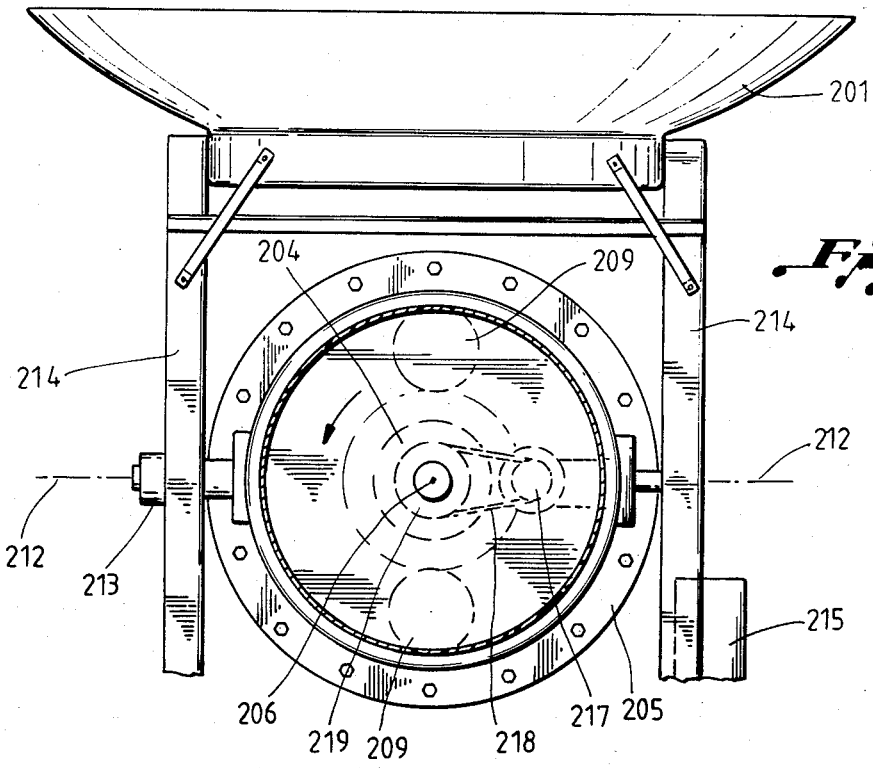
Fig. 10

STABILIZED ANTENNA SYSTEM HAVING AN ACCELERATION DISPLACEABLE MASS

CROSS REFERENCE TO RELATED APPLICATIONS

This application is a continuation-in-part of application Ser. No. 466,222, filed Feb. 14, 1983, now abandoned, which application is incorporated herein by reference.

BACKGROUND OF THE INVENTION

This invention relates to stabilized antenna mountings, generally used when an antenna must be supported upon a mounting which is subject to pitch and roll motions, such as a ship at sea, an offshore drilling platform, a tethered balloon, a ground vehicle, airplane, etc. While the discussion hereinafter will be with reference to a "ship", it will be understood by persons skilled in the art after having the benefit of this disclosure that some of the principles and features of the invention may be equally applicable to other mountings subject to pitch and roll motions, or any periodic vibrations or movements.

There are many applications where an antenna must be supported upon a ship at sea, or some other structure which is subject to pitch and roll motions. In the case of parabolic "dish" antennas, and other high gain antennas, pointed at satellites, it is desirable to maintain the pointing of the antenna generally in a fixed direction. Except in the rare instance of dead calm seas, an antenna mounted directly to the deck of a ship would have unacceptable pointing errors and probable loss of acquisition of the satellite under typical circumstances. In many high performance, narrow beam, military systems, a pointing error of one degree may be unacceptable. It is therefore desirable to support the antenna upon a stabilized platform.

In the past, two axes and three axes tracking antenna mounts have not been entirely satisfactory. The two axes pedestal is inherently limited to less than full hemispherical coverage by the "key-hole" effect when the target is near a line extension of the primary axis where accelerations required for corrective motions become intolerable. A three axes pedestal antenna mounting may provide full hemispherical coverage, but at a cost and complexity which is unacceptable for most commercial applications. For example, highly sophisticated control systems having closed loop servo control for each axis are typically used in such systems, along with associated rate-gyros, accelerometers, and other equipment, even at times including digital computers to perform the complex coordinate conversions. Such complex and expensive systems are not suitable for a large number of applications.

Complex four axes servo systems exist, but in order to make such a servo system sufficiently reliable, it must be expensive. The present invention achieves reliable stabilization at much less cost without servo control.

Further, the mean time between failures is generally inversely related to the complexity of a system. An acceptable mean time between failures is extremely important with antenna system usage. For example, in maritime use, a failure at sea can be costly, and at a minimum, extremely inconvenient.

In many shipboard applications, the antenna is typically mounted upon a mast or tower relatively high above the deck of the ship. This is usually desirable so that the antenna need not "look" through any portion of the ship structure regardless of the orientation of the ship. Antennas are oftentimes mounted fore or aft upon a ship so that the antenna is mounted a considerable distance from the center of the ship. As a result, the antenna will be subjected to linear acceleration forces as the ship pitches and rolls about a point which is usually located near the center of the ship. Such linear acceleration forces tend to cause a platform to tilt, and generally have a destabilizing effect upon the antenna platform.

Many proposed stabilized platforms have failed to compensate for linear acceleration forces. Many prior art patents fail to even recognize the problem of linear acceleration. This is especially true where the application disclosed in the prior art patent does not involve a ship mounted satellite antenna stabilization system. The environment of a shipboard satellite antenna stabilization system is significantly different from those disclosed in typical prior art patents. On a ship, the antenna is typically mounted far from the center of motion, usually high on a mast. The environment is characterized by significant linear acceleration forces. On a few ships, linear acceleration forces can be so great that they can cause a gyro stabilized platform that is not constructed in accordance with the present invention to destabilize and remain in a destabilized condition for a relatively long period of time.

There is a need for reliable stabilized antenna systems which have system costs that are acceptable for commercial applications. There is a significant need developing for relatively low cost, but reliable, antenna systems, particularly with the newer "L" band frequencies allocated for maritime satellite communications.

It is apparent from the above discussion that prior art antenna systems have not been entirely satisfactory. The present invention overcomes some, if not all, of the shortcomings enumerated above.

The present invention includes the feature of an acceleration displaceable mass which tends to compensate for, and offset, forces due to linear acceleration. This invention includes the feature of a stabilized platform which has an azimuth drive independent of the antenna. The azimuth drive of the antenna may be compass slaved so that the stabilized platform remains in a generally fixed orientation as the ship turns underneath, and as the antenna is turned rapidly for purposes such as cable unwraps.

The above features may be included in combination with a gimbal antenna mounting structure on a generally vertically oriented azimuth axis. The present invention preferably has a center of gravity which is located slightly below the gimbal mounting structure. The center of gravity should not be located a substantial distance below the gimbal mounting structure because to do so would provide a substantial gravity couple and make the antenna pedestal susceptible to the destabilizing effects of horizontal accelerations. The present invention features a four axes design, where two axes may be provided with a control interface while the other two axes are passively stabilized, providing a required complexity of control and reliability which is far better than with most conventional two, three and four axes systems.

The invention may include the feature of a pendular acceleration displaceable mass. A preferred embodiment should include the feature of an overall above gimbal system with a "compound pendulum" resonant frequency 10 or more times lower than the resonant frequency of the pendular acceleration displaceable mass. The addition of gyroscopes to the above gimbal system lowers the system resonant frequency greatly without the use of costly low friction, heavy load bearings, and reduces the difficulty of balancing the above gimbal system.

Specific embodiments representing what are presently regarded as the best mode of carrying out the invention are illustrated in the accompanying drawings.

BRIEF DESCRIPTION OF THE DRAWINGS

FIG. 1 is a perspective drawing illustrating an antenna system mounted on top of a mast or a tower in a typical shipboard installation.

FIG. 2 is a schematic diagram illustrating an antenna system with a center of gravity "c.g.", a gimbal mounting "p", and a linear acceleration vector "a" resulting from a pitching motion of the ship which tends to urge the antenna system to rotate about "p" in the direction shown by the curved arrow.

FIG. 3 illustrates a form of an acceleration displaceable mass and a stabilized platform.

FIG. 4 illustrates an alternative embodiment of an acceleration displaceable mass.

FIG. 9 shows a rear view of an antenna mounted upon a stabilized pedestal and illustrates a preferred form of an acceleration displaceable mass.

FIG. 10 is a top view of the stabilized pedestal illustrated in FIG. 9, showing an antenna pedestal incorporating a preferred form of an acceleration displaceable mass, and further illustrating a preferred location of the gyroscopes relative to other system components.

DETAILED DESCRIPTION OF A PREFERRED EMBODIMENT

Figure 5:
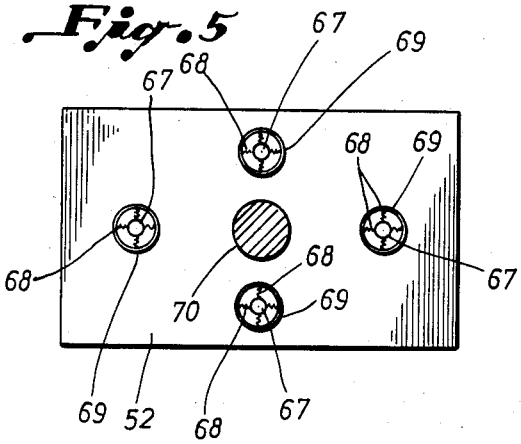
FIG. 5 is a top view of a stabilized platform having four acceleration displaceable masses of the type shown in FIG. 4 arranged symmetrically upon the platform.

As will be explained more fully herein, a preferred embodiment of the present invention uses a combination of features which result in good overall system performance. As will be explained more fully herein, the system preferably has a center of gravity slightly below a gimbal axis to provide a long term reference to gravity, and a stabilized platform preferably having two gyroscopes supported by the platform and mounted on pivotal axes which are substantially at right angles to each other. The gyroscopes are used to reduce errors from transient torques, and to lower the "compound pendulum" resonant frequency of the above gimbal system. The gyroscopes act like a mechanical filter to store and release energy in a manner which smooths rolling and pitching motion such as that typically encountered on a ship at sea. The invention further includes an acceleration displaceable mass to compensate for linear acceleration forces.

An antenna 51 must first acquire, through some form of control, the desired target, such as a communication satellite in a geosynchronized earth orbit. Control of acquisition may be accomplished by remote control. Acquisition generally requires, as a minimum, elevation and azimuth control. An equatorial mounting could conceivably be used having accension and declination control, over azimuth, with equivalent results.

The illustrated four axes antenna system 50 has two controlled axes configured with elevation over azimuth, both configured above a two axes gimbal 53. This can best be understood with reference to FIG. 7. It will be seen from FIG. 7, that the elevation axis 81 and azimuth axis 82 are located above the gimbal 53. The gimbal 53 includes a first gimbal axis 83, and a second gimbal axis 84 which is preferably at a right angle to the first gimbal axis 83. In other words, the gimbal 53 includes orthogonal gimbal axes 83 and 84.

Once the satellite target has been acquired, the pointing attitude of the antenna 51 must be updated for changes in ship's heading and ship's position. Ship's heading changes are preferably automatically compensated in the azimuth axis 82 by slaving an azimuth drive 93 to a ship's compass and ship's position changes. Alternatively, in the case of a ship such as a cargo ship which remains upon a relatively constant heading over a long period of time, changes in ship's heading and ship's position may be updated manually. In some cases, a 100 mile headway may represent less than a two degree tracking error.

The provision of elevation and azimuth control axes 81 and 82 above the gimbal axis, where the pitch and roll axes of the gimbal mounting of the stabilized pedestal are parallel to the pitch and roll axes of the compass to which the azimuth control is slaved, is significant. If the azimuth control, indicated generally by reference numeral 120, is placed below the gimbal axes 83 and 84, pointing errors will result.

In the case of an antenna 51 mounted upon a ship 55, problems created by six primary ship motion disturbances, pitch, roll, yaw, heave, sway and surge, should be considered. The yaw motion is usually handled by slaving an azimuth control to the ship'compass. The motions of a ship 55 require that the antenna control system 50 automatically compensate for angular changes quickly and precisely to avoid excessive pointing errors, and possible degradation or loss of signal.

Referring to FIG. 1, an antenna system 50 is preferably mounted as high as possible above the deck of the ship 55. This is desirable so that regardless of the pointing angle of the antenna 51, and the heading of the ship 55, the antenna 51 is unlikely to suffer degradation or a loss of signal due to interference that would be caused by "looking through" obstructions such as ship masts, smokestacks, conning tower, and other physical obstructions that may be present. In a typical installation, such as that illustrated in FIG. 1, the antenna system 50 is oftentimes placed at a position forward or aft which is remote from the center 58 of the ship 55. In a typical installation such as that shown in FIG. 1, an antenna 51 is mounted upon a stabilized platform 52 having a gimbal joint 53 which is supported upon a tower 54. A radome 56 is preferably provided to reduce wind loading upon the antenna 51.

Referring to FIG. 2, the antenna 51 mounted upon the stabilized platform 52, are both illustrated schematically, mounted upon a support 57.

In the illustration shown in FIG. 2, the ship 55 pitches about its center 58. The antenna support 57 is located a distance "L" from the center of pitch 58 of the ship 55. The antenna platform 52 is located a distance "H" above the plane of the center of pitch 58.

The antenna platform 52 is mounted pivotally upon the support 57 at point "p", which in the illustrated example is a gimbal joint. The center of gravity of the antenna system is shown as point "c.g.", which is located below the gimbal joint "p". The center of gravity "c.g." is shown initially located upon the vertical axis 101.

The antenna system 50, including the antenna 51 and the platform 52, will be subjected to linear acceleration forces as the ship 55 pitches about its center 58. For example, as the ship pitches forward about the center of pitch 58 in the direction shown by the arrow 59, the support 57 will rotate counterclockwise as shown in FIG. 2. This will result in a force acting upon the gimbal point "p" which may be resolved into a vertical component and a horizontal component. The horizontal component is illustrated in FIG. 2, and indicated generally by the reference number "A". The generally horizontal component "A" of the forces acting upon the gimbal point "p" may be thought of as causing this linear acceleration of the antenna system 50. Linear acceleration is sometimes also referred to as horizontal acceleration.

The force "A" may be considered as acting upon the antenna system 50 through the point "p". The center of gravity "c.g." is located a distance "D" below the point "p". Thus, forces such as "A" due to linear acceleration of the antenna system 50 tend to cause the platform 52 to tilt in the direction indicated by the curved arrow 60. In other words, linear acceleration forces may create a turning moment about the center of gravity "c.g.", which in the illustrated example, would be in the direction indicated by the curved arrow 60.

The optimum vertical location of the center of gravity "c.g." is a trade off between friction hysteresis and worst case linear accelerations that may be expected in a given application. Worst case linear accelerations may vary with different types and sizes of ships, and with different location placements aboard the ship 55. These factors may be applicable to a greater or lesser extent, dependent upon the particular application, to installations on other types of vessels, such as balloons, airplanes, offshore drilling platforms, etc.

In minimizing errors due to horizontal linear acceleration, the center of gravity "c.g." would ideally be located coincident with the gimbal point "p". In the example illustrated in FIG. 2, if the center of gravity "c.g." was coincident with the point "p", the force "A" due to linear acceleration would act directly upon the center of gravity "c.g." and a turning moment in the direction of the arrow 60 would not result. That is, the distance "D" of the center of gravity from the gimbal point "p" would be zero. In other words, the turning moment upon the center of gravity "c.g." is equal to the force times the distance "D" that the force acts from the center of gravity "c.g." If the distance "D" is equal to zero, then the product of the force times the distance will also be equal to zero, resulting in a zero turning moment.

However, in minimizing errors due to friction and hysteresis, and to give the antenna system 50 a long term gravity reference and pendulum weight bias, it is desirable to locate the center of gravity as far as possible below the gimbal point "p". In other words, to minimize pointing errors due to friction and hysteresis, the distance "D" shown in FIG. 2 should be as large as possible.

Because the optimum vertical location of the center of gravity is a trade off between minimizing pointing errors due to friction hysteresis and minimizing pointing errors due to linear accelerations, and because these factors may vary with different applications in different locations, an adjustably positionable counterweight is preferably provided to adjust the distance "D" between the center of gravity "c.g." and the gimbal point "p." The distance "D" may also be thought of as the distance between the center of gravity "c.g." and the plane in which the gimbal axes intersect.

An adjustably positionable counterweight may take the form of a downwardly extended bottom threaded stud extension attached to the bottom of the platform 52, and which permits the adjustment upwardly and downwardly of the counterweight by screwing the counterweight along the threaded stud extension. Thus the center of gravity may be adjusted upwardly and downwardly for any particular installation to optimize target tracking performance operational results for that installation.

In a typical installation upon an ocean going ship, the center of gravity should preferably be located as close to the gimbal point "p" as possible, offset a distance "D" which is just enough to overcome the bearing friction or the friction in the gimbal 53 plus a certain safety factor. In a preferred embodiment, the center of gravity may be offset a nominal distance of approximately 0.4 inches below the gimbal 53. The offset distance "D" should preferably be in the range of 0.1 to 0.8 inches, and could be within the range of 0.01 to 3.0 inches depending upon the antenna pedestal size and configuration, and the location, environment and type of motions to which the antenna systems would be subjected.

If the expected conditions of the installation environment remain substantially the same, once the optimum location of the center of gravity is ascertained, the counterweight may not need to be adjustably positionable for a particular antenna pedestal model.

Referring to FIG. 3, the effects of linear acceleration may be offset by providing an acceleration displaceable mass 65. FIG. 3 illustrates schematically how an acceleration displaceable mass may be utilized to shift the center of gravity "c.g." and compensate for destabilizing forces due to linear acceleration.

The acceleration displaceable mass 65 occupies an initial position shown in FIG. 3 by the reference numeral 65. In the example illustrated in FIG. 3, an upper displaceable mass 65 and a lower displaceable mass 65 are provided. In the illustrated example, the acceleration displaceable mass 65 is connected to the platform 52 by a resilient member 66. The resilient member 66 may be a spring. The platform 52 and antenna system have a center of gravity 64 located below the gimbal joint 53.

In an example of a force "A" due to linear acceleration, a turning moment in the direction of the curved arrow 60 would tend to be created about the center of gravity 64.

However, the force "A" due to linear acceleration causes the acceleration displaceable mass 65 to move to a displaced position, indicated in FIG. 3 by the reference numeral 65'. The inertia of the acceleration displaceable mass 65 causes the acceleration displaceable mass 65 to move in the direction indicated generally by the arrow 103. The displacement of the acceleration displaceable mass 65 to the displaced position indicated by the numeral 65' results in a shift of the actual center of gravity to a new position indicated by the reference numeral 64'. In other words, the acceleration displaceable mass 65 causes the center of gravity 64 to dynamically reposition itself in response to forces due to linear acceleration in a manner which, as will be explained below, tends to offset the destabilizing effects of such forces.

When the acceleration displaceable mass 65 is displaced to the position indicated by 65', and the center of gravity moves to the position indicated by reference numeral 64', the center of gravity 64' will be displaced horizontally from the gimbal 53 by a distance "X". The force of gravity acting upon the center of gravity 64' will cause a turning moment in the direction indicated by the curved arrow 102 in FIG. 3, which in this case is generally clockwise. The turning moment due to gravity will be equal to the force of gravity times the distance "X". It will be noted that the turning moment created by the displacement of the center of gravity 64' is in a direction 102 opposite to the direction 60 of the turning moment which results from the force "A" due to linear acceleration. Thus, the displacement of the acceleration displaceable mass 65' and the repositioning of the center of gravity 64' tends to offset the destabilizing effects of forces due to linear acceleration.

The compensating turning moment in direction 102 may be adjusted by changing the distance "X" of the displaced center of gravity 64' under a given set of conditions. In the embodiment illustrated in FIG. 3, this may be accomplished by changing the magnitude of the mass 65, the distance of the mass 65 from the gimbal 53 (i.e., the length of resilient member 66), etc. The compensating turning moment in the direction 102 may also be made equal to the moment in direction 60 due to linear acceleration by reducing the linear acceleration moment. This may be accomplished, for example by reducing the distance "D" of the center of gravity 64 from the gimbal 53. It is desirable that the displaced center of gravity 64' not be displaced to a position lower than the initial positions of the center of gravity 64. If an acceleration displaceable mass 65 were provided only above the platform 52, this could occur. Therefore, it is desirable in this particular illustrated embodiment, to provide an acceleration displaceable mass 65 below the plane of the platform 52 so that the distance "D" will not be lengthened when the center of gravity displaces to a position 64' in response to displacement of the acceleration displaceable mass 65'.

FIG. 9 illustrates a preferred form of an acceleration displaceable mass. In a preferred embodiment, the acceleration displaceable mass 200 should take the form of a pendulum. The acceleration displaceable mass 200 preferably is shaped in the form of a sphere. A shaft 202 connects the acceleration displaceable mass 200 to a pivot point such as a gimbal 203, preferably configured as a U-Joint. The gimbal 203 may be a ball and socket joint, or any linkage that permits the acceleration displaceable mass 200 freedom of movement in any horizontal direction. Alternatively, the acceleration displaceable mass 200 could be suspended from a cable.

In the illustrated example, the gimbal 203 is connected to a support 204 that is attached to the stabilized pedestal 205.

Referring to FIG. 9, the pendular acceleration displaceable mass 200 is shown mounted on the stabilized pedestal 205 near the vertical axis 206 of the pedestal 205. The stabilized pedestal 205 is supported upon a gimbal mounting 207. Horizontal or linear acceleration forces will tend to displace the acceleration displaceable mass 200 from its initial position illustrated in FIG. 9.

The embodiment illustrated in FIG. 9 may be referred to as a "compound pendulum" antenna stabilization system using an acceleration displaceable mass 200 suspended in pendular fashion. This embodiment has significant advantages in "start up time" and transient response. This embodiment also provides an acceleration displaceable mass 200 in a stable position.

It is desirable for a stabilized antenna pedestal to have an advantageous transient response. Most ship motions (other than the ship's forward movement) are generally sinusoidal in nature. However, the energy from a ship's motions which is transmitted to an antenna stabilization system will sometimes contain non-sinusoidal transient components, which may be characterized, for example, as a step, a sawtooth, or an impulse function. Such transients can result from confused seas, freak waves, and other environmental conditions. While the energy content of transients may be relatively small, transients can cause torques to which an acceleration displaceable mass having a high second moment of inertia cannot respond with complete effectiveness.

The disclosed stabilization system includes features intended to improve transient response and overall system performance. The addition of gyroscopes 209 assists in smoothing transients so that the acceleration displaceable mass 200 can effectively respond to the torque exerted upon the stabilized pedestal 205. The gyroscopes 209 tend to store the energy impulse introduced by transient motions, and then slowly release the energy over a period of time where it can be effectively handled by the stabilization system.

The gyroscopes 209 have an additional function which is significant. The stabilized platform 205 is slightly pendular in order to provide a long term vertical reference. The period of oscillation for the pendular above gimbal structure can be derived, or empirically determined. It is desirable for the overall above gimbal system to have a "compound pendulum" resonant frequency 10 or more times lower than the resonant frequency of the acceleration displaceable mass 200. Such a low frequency resonant frequency would otherwise be costly to achieve because it would require very low friction, heavy load bearings. Such low friction bearings would be required due to the very small center of gravity offset that would be required. The addition of gyroscopes 209 tends to lower the above gimbal system resonant frequency greatly, and avoids the need for low friction bearings. The slight vibration of the gyroscope motors tends to overcome the initial friction force that would otherwise exist in the bearings of the gimbal 207.

The above gimbal structure would also require careful static balancing at installation time, but the addition of the gyroscopes 209 makes the above gimbal system easier to balance at installation time and significantly reduces the need for preventure maintenance balancing.

The acceleration displaceable mass 200 is suspended a distance "o" (which should not be confused with zero) from the system gimbal axes 207. The desirable magnitude of the ADM pendulum length "o" interacts with the weight "$W_a$" of the acceleration displaceable mass 200. It is desirable to limit the ADM pendulum length "o" to a convenient length, and to improve the response time of the acceleration displaceable mass 200. It is generally desirable for the acceleration displaceable mass 200 to have a resonant frequency that is as high as possible for quick response, but the resonant frequency should not be as high as 3 Hz for vibration considerations. Due to the interaction of the acceleration displaceable mass weight "$W_a$" and the ADM pendulum length "o", by increasing the weight "$W_a$" of the acceleration displaceable mass 200, we can make the distance "o" smaller, all other factors remaining the same.

The ADM weight "$W_a$" for a sphere-shaped ADM 200, such as is illustrated in FIG. 9, should be equal to the product of the total weight of the system above the gimbal "$W_s$" times the offset "h" of the center of gravity of the system, all divided by the ADM pendulum length "o". Thus, the ADM weight is determined from the formula:

$$W_a = \frac{W_s \times h}{o}$$

It will be appreciated from the above, that if the weight of the acceleration displaceable mass is made too small, then the ADM pendulum length will be clumsily long.

The antenna system above the gimbal 207 has a center of gravity 208 that is slightly offset a distance below the gimbal mounting 207. This slight offset is preferably just enough to overcome the friction in the gimbal 207, plus a safety factor. The safety factor is included to take into account aging of the bearings, deterioration of lubrication, weathering, temperature changes, and other conditions which may affect the amount of friction in the bearings. The C.G. offset should not be substantially long, because that would make the platform 205 unduly responsive to horizontal or linear accelerations. The C.G. offset provides a long term reference to gravity which tends to maintain the antenna system above the gimbal 207 in a vertical orientation in the absence of other motions. An initial C.G. offset distance "h" of approximately 1.74 inches, without the acceleration displaceable mass 200, should produce satisfactory results for a 135 lb system. When the acceleration displaceable mass 200 is added as illustrated, the center of gravity is raised. Adding the illustrated acceleration displaceable mass 200 should preferably raise the center of gravity offset to a static C.G. offset that is nominally about 0.4 inches. The center of gravity offset for the above gimbal system plus the acceleration displaceable mass should preferably be in the range of 0.1 to 0.8 inches, but could be within the range of 0.01 to 3.0 inches.

Displacement of the acceleration displaceable mass 200 will cause the position of the center of gravity for the entire stabilization system, that is, the entire above gimbal system and the ADM 200, to shift. Thus, the entire stabilization system will have a dynamic center of gravity that may move and change location during operation. The stabilization system is designed so that the center of gravity for the entire stabilization system is dynamically repositioned to counteract torque that may result from linear acceleration forces.

A suitable approach to constructing an embodiment of the invention should involve the steps of (1) selecting the gimbal bearings on a basis of life and shock loading, rather than emphasizing low friction; (2) determining the minimum C.G. offset distance between the gimbal axes and the center of gravity for the above gimbal system which will provide a sufficient pendular restoration force to overcome bearing friction in the gimbal 207; (3) sizing the acceleration displaceable mass 200 so that it will offset the torque affecting the above gimbal system due to horizontal or linear acceleration; and (4) determining the size of the gyroscopes 209 that is sufficient to overcome expected transient forces.

The first three enumerated steps have been discussed above. One advantage of the present invention is that costly low friction gimbal bearings are not required. The determination of the minimum offset distance for the center of gravity may be done empirically. As discussed above, a safety factor, typically 50 percent, is preferably added to the amount of the C.G. offset.

The weight "$W_a$" of the acceleration displaceable mass 200 is determined by referring to a worst case scenario for a pedestal 205 that has been tipped. If the pedestal 205 is considered as if it had been tipped 90° from a horizontal initial position, then the torque due to the weight of the above gimbal system (without the acceleration displaceable mass weight) would be equal the product of the total weight "$W_s$" of the above gimbal system (without considering the weight of the acceleration displaceable mass) times the offset distance "h" of the center of gravity of the above gimbal system (without considering the weight of the acceleration displaceable mass). The weight of the acceleration displaceable mass 200 is preferably designed so that it produces a torque substantially equal to the torque calculated by the product of "$W_s$" times "h". The ADM torque is equal to the product of the weight "$W_a$" of the acceleration displaceable mass 200 times the effective distance "o" between the gimbal 207 and the point where the ADM weight is applied. In the illustrated embodiment, the distance "o", which may be referred to as the ADM offset, is the distance between the gimbal 207 and the ADM gimbal joint 203. If the pedestal 205 is considered to be tipped 90°, then the torque produced by the weight of the ADM 200 would be equal to "$W_a$" times "o".

In practice, the torque produced by the ADM, as calculated above, may be made less than the product of "$W_s$" times "h", and the invention should still yield satisfactory results. If the torque produced by the ADM is slightly less, then the stabilized pedestal 205 will generally always have a tendency to come to rest in an upright position because the torque due to the gravity restoration force will be slightly greater than the torque produced by the ADM 200.

The torque produced by the acceleration displaceable mass 200 is equal to the product of "$W_a$" times "o". Various combinations of weight "$W_a$" and offset "o" may yield an equivalent ADM torque. In a given design, the ADM offset "o" may be selected to be a convenient length. Then the weight "$W_a$" of the ADM 200 can be calculated from the equation:

$$W_a = \frac{W_s \times h}{o}$$

For a 135 lb antenna pedestal 205, the ADM offset "o" may be selected to provide an ADM weight "$W_a$" of 16 lbs, which in practice should be convenient, and effective.

An alternative method for determining the appropriate size for the acceleration displaceable mass 200 involves calculating the sum of the moments about the gimbal 207. The sum of the moments about the gimbal 207 is equal to the second moment of inertia "Ims" for the total above gimbal system (not considering the ADM 200) multiplied times the angular acceleration "$a_s$" for the system.

Figure 13:
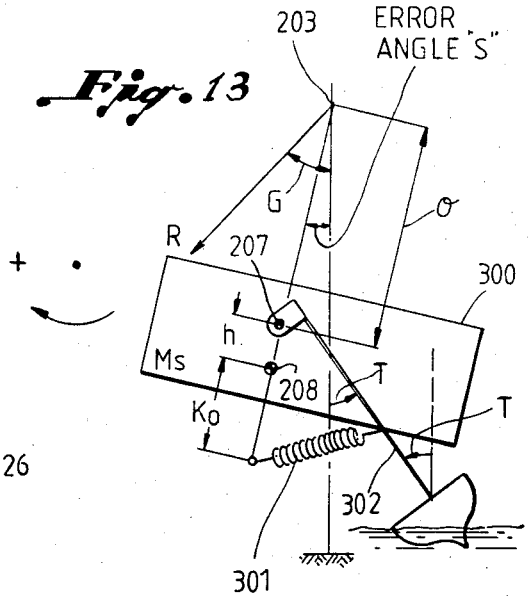
FIG. 13 is a schematic diagram of a pedestal mounted on the mast of a ship.

The following analysis can best be understood with reference to FIG. 13.

The horizontal acceleration error torque may be considered as equal to the expression:

$$hM_s a_x \cos S$$

where "h" is the offset of the center of gravity of the above-gimbal system without the acceleration displaceable mass 200, as shown in FIG. 13; "$M_s$" is the total mass of the above gimbal system without the ADM 200; "$a_x$" is the magnitude of the horizontal acceleration; "S" is the error angle, as shown in FIG. 13. Multiplying "$a_x$" by the cosine of the "S" gives the component of the horizontal acceleration which tends to tip the platform 300, shown schematically in FIG. 13. The method for calculating "$a_x$" will be discussed below.

The vertical acceleration torque may be considered as equal to the expression:

$$hM_s a_y \sin S$$

where "$a_y$" is the magnitude of the vertical acceleration; "h" is the C.G. offset as discussed above; "$M_s$" is the mass of the system as discussed above; and "S" is the error angle, as shown in FIG. 13. Multiplying "$a_y$" by the sine of "S" gives the component of the vertical acceleration which tends to tip the platform 300. A method for calculating "$a_y$" will be discussed below.

The torque due to the weight of the system may be considered as equal to the expression:

$$-W_s h \sin S$$

where "$W_s$" is the total weight of the above gimbal system without the acceleration displaceable mass 200. Alternatively, the mass of the system "$M_s$" times the acceleration of gravity "g" could be substituted for "$W_s$". "h" is the C.G. offset and "S" is the error angle, both of which are shown in FIG. 13. Multiplying "g" times the sine of "S" will give the component of the force of gravity which tends to urge the platform 300 back to a horizontal orientation. Multiplying "$W_s$" by the sine of "S" yields the same end result in the analysis described herein.

The angular displacement "S" may be calculated as a function of time "t" from the following equation:

$$S = S_o + V_o t + \tfrac{1}{2} A_s t^2$$

where "$S_o$" is an initial angle at time t=0; "$V_o$" is an initial angular velocity at time t=0; and "$A_s$" is the angular acceleration over the period of time t.

A determination of the horizontal acceleration force developed and applied to the system at the gimbal 207 must take into consideration the fact that, in the environment of a ship mounted satellite antenna stabilization system, the pedestal 205 will typically be mounted high on a mast a distance removed from the pitch or roll center of the ship, as illustrated in FIG. 2.

The maximum angle that the ship will roll or pitch, and the maximum roll period may be specified, (the INMARSAT specifications are of particular interest in this case), empirically determined, or they can be based upon a worst case analysis.

If we let "$T_m$" be the maximum roll angle that the ship motion will experience (in the INMARSAT specifications this may be 30°), and express it in radians, then the instantaneous roll angle "T" is equal to $T_m$ sin wt where "w" is equal to two pi divided by the roll period in seconds. For the INMARSAT specifications, the minimum roll period is eight seconds.

If "H" is the height above the roll center, then the horizontal distance moved at time "t" is given by the expression:

$$S_x = H \sin T$$

The first derivative of "$S_x$" (the horizontal distance moved at time "t") is the horizontal velocity:

$$V_x = (T_m w \cos wt) H \cos T$$

or $$V_x = T_m w H \cos(wt) \cos T$$

The second derivative of "$S_x$" gives the horizontal acceleration "$a_x$", which simplifies as the expression:

$$a_x = -T_m H w^2 [T_m \cos^2 wt \sin (T_m \sin(wt)) + \sin(wt) \cos(T_m \sin(wt))]$$

The vertical acceleration "$a_y$" can be similarly determined. Again, the instaneous roll angle is:

$$T = T_m \sin wt$$

The distance moved in the vertical direction "$S_y$" is given by the expression:

$$S_y = H \cos T$$

The first derivative of "$S_y$" with respect to time is the velocity "$V_y$" in the vertical direction:

$$V_y = -T_m H w \cos(wt) \sin T$$

The second derivative of "$S_y$" with respect to time gives the vertical acceleration "$a_y$":

$$a_y = T_m H w^2 [-T_m \cos^2 wt \cos(T_m \sin(wt)) + \sin(wt) \sin (T_m \sin(wt))]$$

This analysis assumes movement in a roll direction only. Further complicating the analysis by considering several motions simultaneously would detract from the clarity of the explanation, and would not significantly improve the ultimate results. The analysis is intended to illustrate the principals involved, and not necessarily to model simultaneously every motion that a ship could make.

Usually, the linear motions of heave, sway and surge cause forces which are small enough when compared to the linear components of acceleration (tangential and normal) acting on the antenna stabilization system as a result of pitch and roll of the ship, that they do not need to be dealt with separately.

The above expressions provide a method of determining the size of the acceleration displaceable mass 200 that is required. Referring again to FIG. 13, if we sum the moments about the gimbal 207, we can determine the amount of correction torque that must be supplied by the acceleration displaceable mass 200. Without the ADM 200, the sum of the moments about the gimbal 207 is:

$$I_{ms}a_s = hM_s a_x \cos S + hM_s a_y \sin S - W_s h \sin S$$

Referring to FIG. 13, the acceleration displaceable mass 200 may be considered as supplying a correction force "R" at an angle "G". Thus, the ADM correction torque is given by the expression:

$$-oR \sin (G-S)$$

where "o" is the distance from the gimbal 207 to the pivot point 203 of the acceleration displaceable mass 200.

This expression can then be solved to determine the magnitude of "R" that is required to correct for torques tending to tip the platform. Such analysis can conveniently be performed by computer calculations.

The force "R" can be determined from a summation of moments about the pivot point 203 of the acceleration displaceable mass 200. The sum of the moments is equal to the second moment of intertia for the ADM 200 times the angular acceleration. The illustrated acceleration displaceable mass shown in FIG. 9 may be modeled as a single pendulum, or as a compound pendulum. Because the length of the shaft 202 is preferably kept short to improve response time, the ADM 200 has been treated as a compound pendulum in the present analysis.

The angle of displacement of the ADM pendulum at any point in time may be expressed as angle "G" which varies with time. Because the size of the offset "o" is very small as compared with the size of the ship and the height "H" of the mast, we may consider "$a_x$" and "$a_y$" for the acceleration displaceable mass to be the same "$a_x$" and "$a_y$", respectively, as derived above for the stabilized pedestal. Using this assumption, the angular acceleration for the ADM 200 may be expressed as:

$$\frac{p\,(-g \sin G + a_x \cos G + a_y \sin G)}{2/5\, r^2 + p^2}$$

where the acceleration displaceable mass 200 is a sphere, and the second moment of inertia of a sphere is taken as $2/5\ M_A r^2 \times M_A P^2$; "r" is the radius of the ADM sphere, and "p" is the distance from the center of the ADM sphere to the ADM pivot point 203. The angle G at any given time "t" can be determined by double integration of the above expression for angular acceleration from time zero to the given time "t".

The magnitude of force "R" is given by the expression:

$$R = M_A[(g-a_y) \cos G + a_x \sin G]$$

where "$M_A$" is the mass of the acceleration displaceable mass 200; "g" is the acceleration due to gravity; "$a_y$" is the vertical acceleration; "G" is the angle as shown in FIG. 13; and "$a_x$" is the horizontal acceleration.

The force "R" acts at an ange "G", as shown in FIG. 13.

The expression for "R" may be solved for "$M_A$" to determine the mass required for the ADM 200 to produce the desired correction force "R". Alternatively, different combinations of mass "$M_A$" and ADM offset "o" can be plugged into the expression and the results readily calculated by computer analysis until the most desirable combination of factors for a given application is determined.

The final step in the four enumerated steps for making a preferred embodiment of a stabilized pedestal using the teachings of the invention is the step of determining the size of the gyroscopes 209. The size of the gyroscopes 209 that is required depends upon the expected operational environment of the stabilized antenna system.

The gyroscopes 209 smooth transients, and lower the resonant frequency of the above gimbal system. The gyroscopes 209 apply a correction force which assists the acceleration displaceable mass 200, particularly during periods of time when forces act on the platform 205 in a manner that is too quick for the acceleration displaceable mass 200 to respond.

The sum of the moments about the gimbal 207 is analyzed, typically by computer analysis of the equation:

$$I_{ms}a_s = hM_s a_x \cos S + hM_s a_y \sin S - W_s h \sin S - oR \sin G - S$$

which was derived and discussed above. Particular attention is directed to worst case scenarios or conditions. The gyroscopes 209 are sized to accommodate the largest expected angular acceleration "$a_s$". Such a computer analysis can produce the amount of work which must be performed by the gyroscopes 209.

A gyroscope 209 supplies a torque equal and opposite to couples which are applied in the spin plane of the gyroscope. The gyroscope torque is equal to the rotational mass moment of inertia times the angular or spin velocity times the precession angular velocity. The rotational mass moment of inertia for a gyroscope 209 is equal to the product of the mass of the rotor or flywheel times the square of the radius of gyration.

From these relationships, the gyroscopes 209 may be sized to accommodate the expected forces. An empirical analysis shows that much smaller gyroscopes 209 may be used in this invention, as compared to a passively stabilized antenna pedestal without an acceleration displaceable mass 200. This is a significant advantage, because the total cost of the antenna stabilization system can be significantly reduced. As a result, the usefulness of the invention is substantially increased, and it is placed within the financial reach of a larger number of users. The consequent benefit to society is apparent.

The gyroscopes 209 also prevent the acceleration displaceable mass 200 from over correcting in the presence of a heave motion. When displaced, the acceleration displaceable mass 200 responds to heave or vertical motions. The pedestal 205 generally does not tip in response to heave motions. Thus the gyroscopes 209 smooth out the ADM's response to vertical motions in comparison to the platform's non-response.

The size of the gyroscopes 209 can be affected by a deviation from the design relationship expressed as the ratio of the product of the weight of the above gimbal system "$W_s$" times "h" to the weight of the ADM "$W_A$" times "o". This equation was discussed previously. In the case where:

$$\frac{W_A o}{W_s h} = 1$$

the gyroscopes 209 may be small.

In some applications, it may be desirable to increase the ADM correction force. The ratio may be increased by as much as three to one, that is:

$$\frac{W_A o}{W_s h} = 3$$

In such an event, the gyroscopes 209 will need to be larger for motions where the acceleration displaceable mass 200 over corrects. The ratio may be reduced to a point approaching zero. In that event, the advantages realized by including the acceleration displaceable mass 200 will be reduced, and the gyroscopes 209 will need to be larger in order to compensate.

It will be appreciated from the above teachings that the addition of gyroscopes 209 to the stabilization system increases the system tolerance for errors in determining the size of the ADM 200.

In some embodiments, a spring 301 attached between the pedestal 300 and the mast 302 may be desirable. The spring 301 is offset a distance "$K_o$" below the center of gravity 208. The spring 301 has a spring constant "K". Thus the spring correction moment is given by the equation:

$$-K\,(K_o \sin (T+S))_o$$

which is the product of the spring constant "K" times the distance that the spring was pulled $K_o \sin (T+S)_x$ times The lever arm "$K_o$" through which it pulls.

Thus, the sum of the moments about the gimbal 207 would include a torque due to the spring:

$$-oR \sin (G-S)+hM_s a_x \cos S+hM_s a_y \sin S - W_s h \sin S - K\,(K_o \sin (T+S))$$

The determination of the mass for the ADM 200 or the size of the gyroscopes 209 would then be performed as above, considering also the torque due to the spring 301.

A spring 301 may be helpful in reducing the amount of force correction required from the acceleration displaceable mass 200 and gyroscopes 209, if the forces tending to tip the platform 300 are sinusoidal in nature. The spring 301 acts opposite to the horizontally applied acceleration forces. The spring 301 may also assist in increasing the oscillatory period of the above gimbal system, or in reducing the resonant frequency of the above gimbal system. A spring 301 is generally useful in the environment of a ship mounted antenna. On other vehicles where motions are not sinusoidal, a spring 301 may be detrimental.

The spring 301 may be a torsional spring in the gimbal 207. In certain circumstances, the cables running between the platform 205 and the ship may act as springs 301 and assist in stabilization.

Referring further to FIG. 9, the illustrated acceleration displaceable mass 200 is pivotally mounted within a housing 210. The housing 210 may be cone shaped with a flat mounting plate 204, which is adapted to receive a gimbal support shaft 211. The housing 210 is supported upon the stabilized pedestal 205. The acceleration displaceable mass 200 must be mounted so that it is in mechanical communication with the stabilized pedestal 205 in order for the ADM correction forces to be applied directly to the pedestal 205.

An antenna 201 is mounted to the stabilized pedestal 205 through an elevation control that includes an elevation axis 212, and an elevation drive motor 213. The illustrated embodiment uses a direct drive elevation control. Thus, the antenna 201 can pivot, or rotate, about the elevation axis 212 in order to raise or lower the antenna pointing angle. The antenna 201 is supported on arms 214, which are best shown in FIG. 10. An electronics package 215 is preferably mounted on one of the arms 214 to assist in counterbalancing the antenna 201. Other counter weights may be added to the arms 214 for balancing.

An azimuth drive motor 216 is shown in FIG. 9. The azimuth drive motor 216 preferably has a sprocket 217 and chain 218 drive. The chain 218 also engages a sprocket 219 which is fixed to an above gimbal post 220. The illustrated azimuth drive motor 216 is fixed to the pedestal 205 so that the motor 216 actually "walks around" the post 220 when the azimuth position of platform 205 is changed.

Azimuth bearings 221 are provided as shown.

The above gimbal structure rests upon a support 222, which may be part of a mast or tower.

Figure 11:
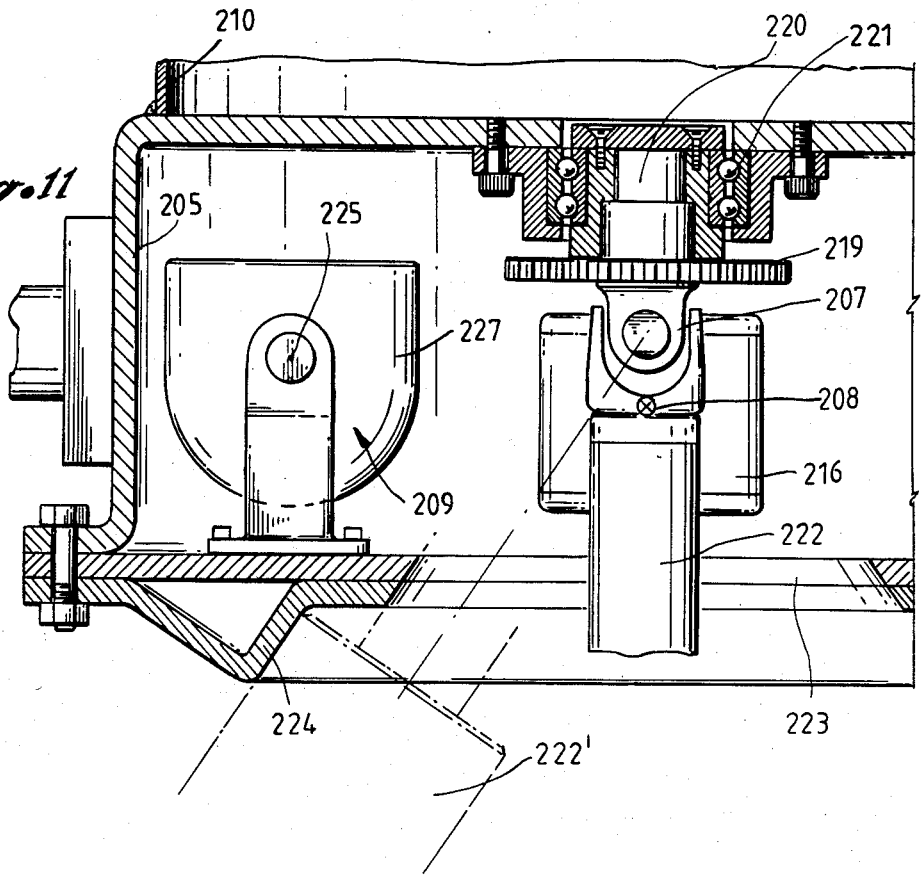
FIG. 11 shows details of a gyroscope mounting and the platform mounting of the embodiment illustrated in FIGS. 9 and 10.

Details of the gimbal 207 mounting structure are illustrated in FIG. 11. The gimbal 207 includes two axes which should intersect each other, and should be at right angles to each other. The support 222, shown shaped as a post, extends through an opening 223 in the platform 205. The opening 223 is large enough to allow the platform 205 to remain horizontal as the support 222 moves underneath it. During operation of the stabilized pedestal, the support post 222 may become displaced from its initial position such that it moves to a displaced position, as shown by the ghost lines in FIG. 11, indicated generally by the reference numeral 222'.

If the support 222 is displaced too far, it may encounter a stop 224, as shown in FIG. 11, which prevents further angular displacement of the support 222. The opening 223, shown cross-sectionally in the cut away view of FIG. 11, is preferably circular.

The gyroscope 209 preferably has a pivotal axis 225, where the gyroscope 209 is pivotally mounted to a gyro support 226. In the illustrated example, the gyroscope 209 is shown covered by a gyro housing 227. The gyroscope 209 is pivotally mounted so that it can precess in response to the application of upsetting torques to the pedestal 205. The gyroscope 209 preferably has a center of gravity which is slightly below the precession axis 225 in order to provide a vertical reference to the gyroscope 209.

In a preferred embodiment, two gyroscopes 209 are used. The two gyroscopes 209 are mounted so that their precessional axes are perpendicular to each other. More than two gyroscopes 209 can be used, if desired. For example, four gyroscopes operating in two pairs could be used with equivalent results.

Figure 12:
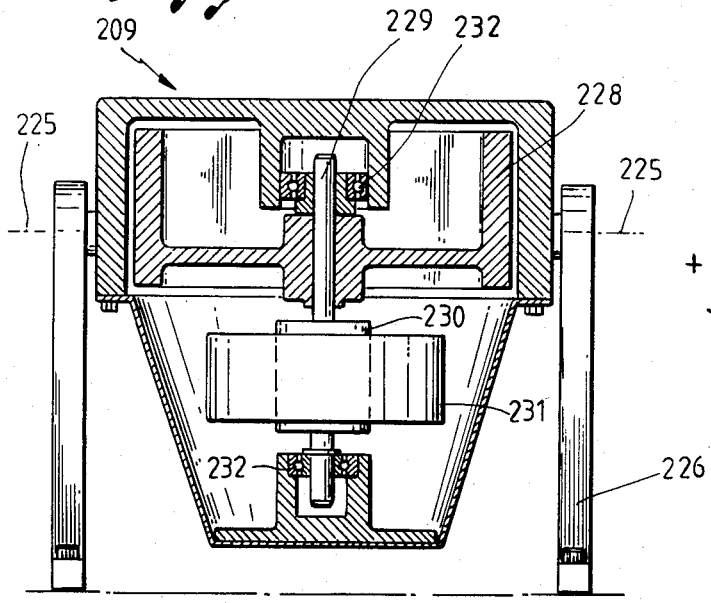
FIG. 12 shows a cutaway side view of the gyroscope illustrated in FIG. 11.

FIG. 12 illustrats a cutaway view of a gyroscope 209 with the cover 227 removed. The gyroscope 209 has a flywheel 228, which is shown in cross section. The flywheel 228 spins upon a shaft 229 connected to a rotor 230, which forms part of the gyroscope motor. The gyroscope 209 also includes a stator 231 which is supported by suitable brackets (not shown). Gyro bearings 232 are provided to facilitate rotation of the shaft 229.

When electrical energy is supplied to the gyro motor, including stator 231, the rotor 230, shaft 229 and flywheel 228 are caused to rotate at a suitable spin velocity, which is determined by the amount of gyroscopic correction force that is needed for stabilization.

FIG. 4 illustrates an alternative embodiment of an acceleration displaceable mass 67. The mass 67 is supported in an initial position by resilient members or springs 68. The spring 68 may be conveniently disposed against a support 69. In the example illustrated in FIG. 4, the support 69 takes the form of a ring. Although four resilient members 68 are illustrated, it will be appreciated that more resilient members 68 could be provided. Alternatively, the mass 67 may be maintained in an initial position by three resilient members 68 which are preferably positioned approximately 120° apart. The return of the acceleration displaceable mass may be accomplished through the use of preloading in the spring 68 or other means.

Figure 8:
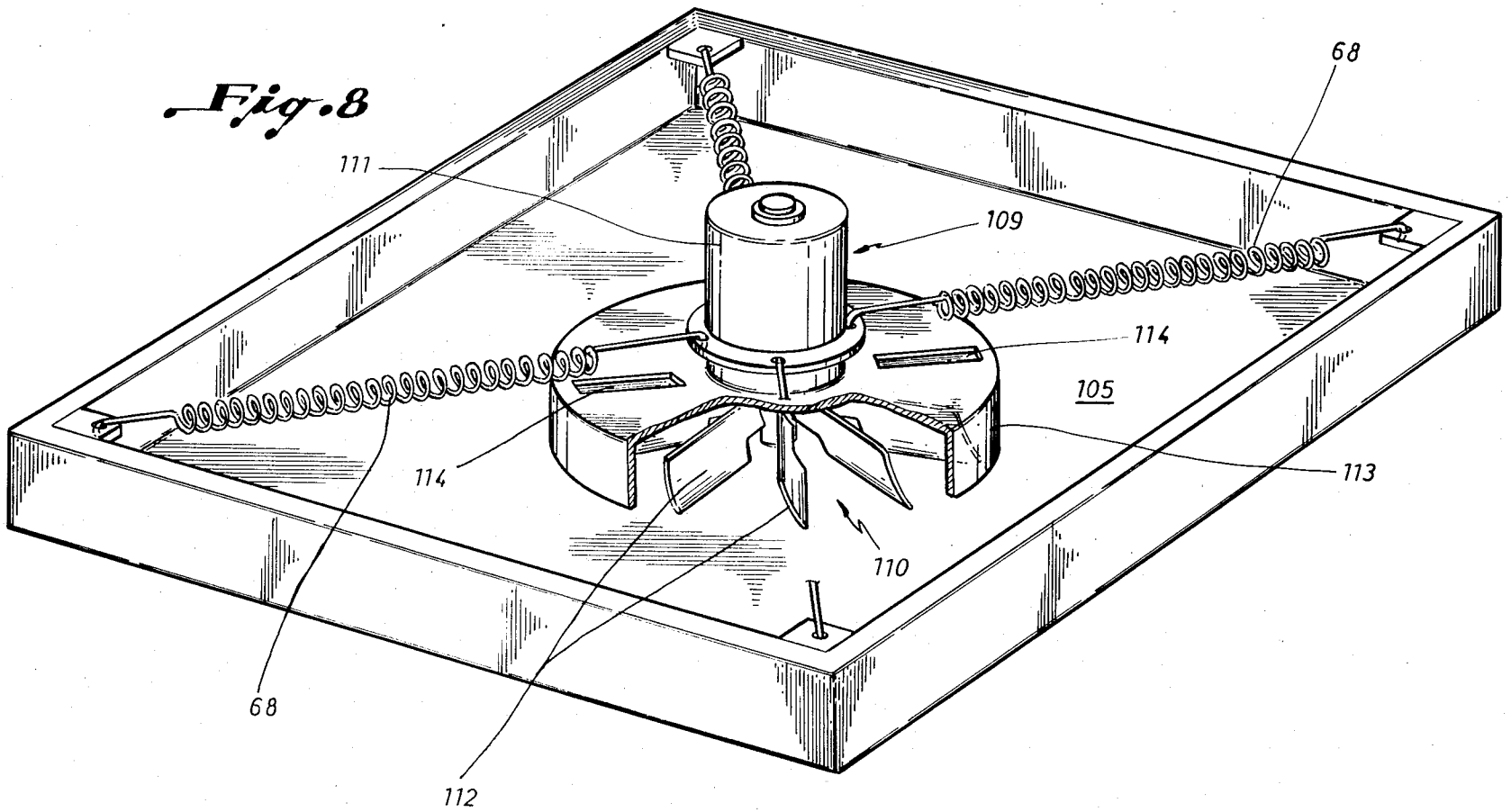
FIG. 8 illustrates yet another alternative embodiment of an acceleration displaceable mass.

Alternatively, an acceleration displaceable mass 109 could be mounted on air bearings to reduce the friction between the sliding mass 109 and supporting surface 105. Alternatively, the sliding mass 109 could be a fan or blower that produces sufficient air flow to support itself on an air film as illustrated in FIG. 8. It may be maintained in an initial position by resilient members such as springs 68. A fan or blower 110 could also function simultaneously as a gyroscope to provide stabilization. In the case of air bearings, corrosion of steel bearings in a corrosive environment would not be a problem. The fan 110 preferably includes a motor 111 having blades 112 rotatably attached thereto. The blades 112 have a housing 113 covering them, which has one or more air slots 114. Rotation of the blades 112 creates an air film upon which the mass 109 floats upon surface 105.

FIG. 5 illustrates a top view of a platform 52 having four acceleration displaceable masses 67, which may be of the type shown in FIG. 4. The platform 52 is supported by a mast 70, shown in cross-section in FIG. 5. The acceleration displaceable masses 67 are preferably arranged symmetrically upon the platform 52 about the mast 70 to provide balance.

Figure 6:
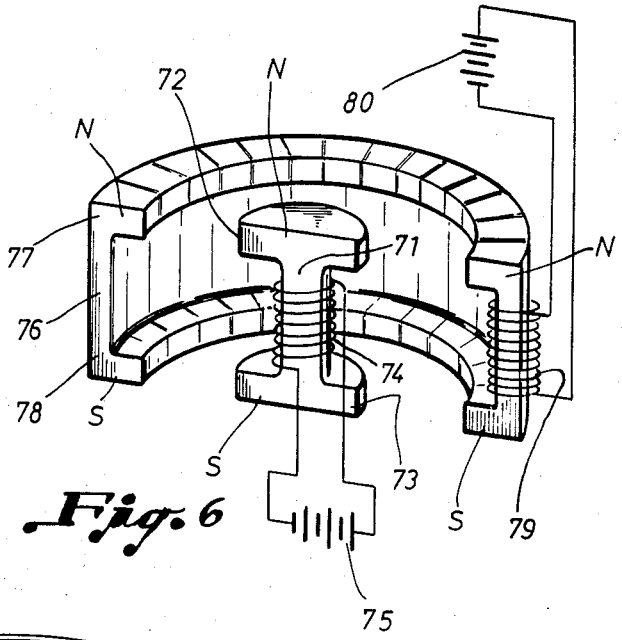
FIG. 6 illustrates an alternative embodiment of an acceleration displaceable mass.

FIG. 6 illustrates a perspective view of yet another embodiment of an acceleration displaceable mass 71. In this example, the acceleration displaceable mass 71 is held in an initial position by electromagnetic forces.

The acceleration displaceable mass 71 forms an electromagnet having a north pole 72 and a south pole 73. A magnetic field is induced in the acceleration displaceable mass 71 by a coil 74 which is electrically coupled to a source of electromotive force, or electrical power 75. Those skilled in the art will appreciate that the coil 74 must be wound in a particular orientation in order to achieve the desired polarity of magnetism represented by the north pole 72 and the south pole 73 of the mass 71. The acceleration displaceable mass 71 should preferably be fabricated from a ferrous material, such as iron.

The acceleration displaceable mass 71 is maintained in an initial position by a support magnet 76. The support magnet 76, shown in a cross-sectional perspective view, may be magnetized by a coil 79, or series of coils, which are connected to a source of electromotive force, or electrical power 80. The coil 79 is wound so that the support magnet 76 will have a north pole 77 and a south pole 78 which correspond, respectively, to the north pole 72 and the south pole 73 of the acceleration displaceable mass 71. According to the principles of magnetism, like poles 77 and 72 will repel each other. Similarly, like poles 78 and 73 will repel each other. If the support magnet 76 is preferably constructed in the shape of a circle or ring, the support magnet 76 will tend to urge the acceleration displaceable mass 71 resiliently toward an initial position generally in the center of the support magnet 76. However, the inertia of the mass 71 will overcome the forces of magnetism in a preferred embodiment and allow the mass 71 to displace when the forces of linear acceleration tend to accelerate the support magnets 76, which is ordinarily mechanically connected to the antenna system 50.

Figure 7:
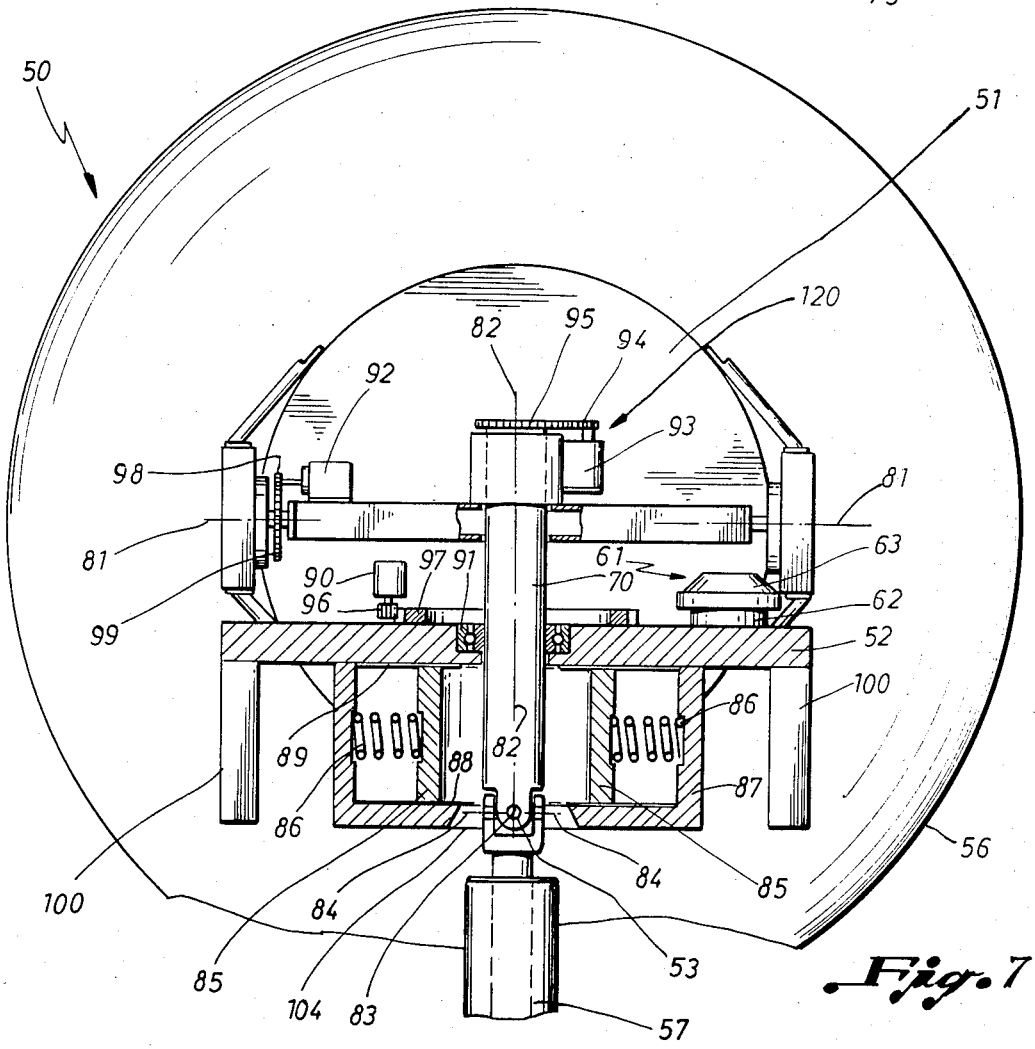
FIG. 7 shows a rear view of an antenna mounted upon a stabilized platform, illustrating another embodiment of an acceleration displaceable mass.

FIG. 7 illustrates an embodiment of an antenna system 50, utilizing yet another embodiment of an acceleration displaceable mass 85. The antenna system 50 preferably has a center of gravity (not shown) located slightly below the gimbal joint 53. The location of the center of gravity may be adjusted by varying counterweights 100. The antenna 51 is supported by a mast 70. Acquisition of the satellite target is accomplished by elevation drive 92 which rotates the antenna about elevation axis 81, and azimuth drive 93 which rotates the antenna about azimuth axis 82.

The mast 70 is maintained in a generally stabilized orientation by the action of the stabilized platform 52, and the pendulum effect due to the offset of the center of gravity below the gimbal 53. The gimbal 53 preferably has a first gimbal axis 83 which is generally perpendicular to a second gimbal axis 84. The right angled gimbal axes 83 and 84 preferably lie in a common horizontal plane defining the gimbal joint 53. This gimbal construction is similar to a "U-joint", such as used in an automobile power train system.

The stabilized platform 52 preferably includes a gyro 61. The gyro 61 comprises a gyro motor 62 and gyro rotor 63. The motor 62 spins the rotor 63 rapidly to create a gyroscopic effect. The gyro 61 is preferably supported by the platform 52. Two gyros 61 may be provided which are pivotally mounted such that their pivot axes are at right angles to each other. Such pivoting will permit the gyros 61 to precess about their pivotal axes. If two or more gyros 61 are used, they are preferably mounted so that they have a center of gravity which is below their pivotal axes so that gravitational forces tend to urge the gyros 61 to a vertical orientation. This may also be thought as a precession restraining means. Either of the gyros 61 may be mounted above or below the platform 52. The gyros 61 may alternatively be tilted in a non-vertical position. In such case, it is preferable to tilt the gyros 61 in a symmetrical arrangement.

The acceleration displaceable mass 85 compensates for otherwise destabilizing forces due to linear acceleration. The acceleration displaceable mass 85, shown in FIG. 7 in cross-section, may take the form of a ring or, in other words, may be cylindrical in shape. The acceleration displaceable mass 85 is supported by a support housing 87. The mass 85 is free to slide horizontally within the support housing 87. For example, in FIG. 7, the acceleration displaceable mass 85 is free to slide to the right or left within the support housing 87. Although FIG. 7 is a two-dimensional drawing, the acceleration displaceable mass 85 is also free to slide in a direction which would be into and out of the page, and all directions intermediate thereto. That is, the acceleration displaceable mass 85 is preferably provided with 360° of freedom of movement within the horizontal plane.

The housing 87 has an opening or aperture 104 through which the mast 70 passes, and permits freedom of movement of the support 57 and the mast 70 with respect to each other about the gimbal 53. The support housing 87 preferably has a lower surface 88 which is teflon coated to facilitate sliding movement of the mass 85. Similarly, the lower surface 89 of the platform 52 is preferably teflon coated. Alternatively, the sliding mass 85 can be teflon coated and the lower surface can be glass or polished metal. The mass 85 might even be supported on three or more legs, the bottoms of which can be teflon coated.

The acceleration displaceable mass 85 is maintained in an initial position by resilient members 86. The resilient members 86 may be springs. Alternatively, the acceleration displaceable mass 85 could be maintained in an initial position by electromagnetic means, by electrostatic forces, by hydraulic means, or by other means which will be apparent to those skilled in the art.

Significantly, the azimuth drive 93 is provided above the gimbal plane, or gimbal joint 53. This is significant, in that pointing errors may result if the azimuth drive is located below the gimbal 53.

It is not necessary to connect the platform 52 to the antenna 51 directly. In the illustrated example, the platform 52 stabilizes the orientation of the mast 70 upon which the antenna 51 is mounted. Thus, the platform 52 is mechanically coupled to the antenna 51 through the mast 70. Stabilization of the platform 52 will tend to stabilize the antenna 51 and tend to maintain the pointing of the antenna 51 generally in a fixed direction during pitch and roll motions of the ship or platform upon which the support 57 is mounted.

The connection of a satellite receiver to the antenna 51 by slip rings is undesirable, and may not comply with overall system (e.g., INMARSAT) specifications. It is therefore oftentimes necessary to rapidly reposition the azimuth setting of the antenna 51 (i.e., by rotating the antenna 51 rapidly about the azimuth axis 82), in order to unwrap cables. If the platform 52 is rapidly turned, it will tend to destabilize the gyro 61. In the embodiment illustrated in FIG. 7, it is not necessary to rotate the platform 52 when the azimuth setting of the antenna 51 is changed.

The platform 52 is preferably rotatably disposed upon the mast 70. A ring bearing 91 is provided to facilitate rotation of the platform 52 about the mast 70. Because some friction will, in most practical systems, be present in the bearings 91, it is desirable to provide a platform azimuth drive 90 which is adapted to rotate the platform 52 about the mast 70. In a preferred embodiment, the platform drive 90 is slaved to a ship's compass, so that as the ship changes its compass heading, the orientation of the platform 52 is changed by the drive 90 so that the platform 52 remains in a generally fixed orientation with respect to compass heading. In effect, a ship will turn underneath the antenna system 50 while the antenna system 50 remains substantially motionless.

The platform drive 90 is connected to the mast 70 by gears 96 and 97.

Stepping motors are preferably used for the elevation drive 92 and the azimuth drive 93. Use of stepping motors provides a significant advantage in that residual torque due to the permanent magnetic fields of the stepping motors imposes a requirement for power to the elevation and azimuth axes only when heading changes occur or the vessel has moved a major distance. In many installations, neither of these conditions occur frequently, and as a result, the pedestal is in a zero power non-driven state during a high percentage of its useful life. As a further advantage, while a conventional servo controlled active system would literally "fall down" with a power failure, the utilization of stepping motors tends to maintain the last set elevation in azimuth positions which were set before a power failure, and will thereby maintain useful communications for a relatively long period of time as long as the ship's heading is maintained within a few degrees.

Conventional active servo motors could be utilized for the elevation drive 92 and the azimuth drive 93, as well as the platform drive 90, provided their commutation sparking was environmentally acceptable.

An alternative embodiment of the invention could utilize selsen torquers in the place of the gyros 61. This could eliminate a more expensive gyro in exchange for two relatively inexpensive small components.

Component selection and adjustment of the acceleration displaceable mass of the type illustrated in FIGS. 4–8 may be facilitated by considering that linear acceleration will cause a tipping moment, torque or couple on the platform according to the following formula:

$$MLA = D\, m_t a_{LA}$$

where $M_{LA}$ is the tipping moment of the linearly accelerated system;

D is the offset between the gymbal and the antenna platform's center of gravity;

$m_t$ is the total mass of the antenna platform; and, $a_{LA}$ is the linear acceleration component.

The offsetting moment generated by the acceleration displaceable mass should be:

$$M_{DM} = X\, m_{dm}\, g$$

where $M_{DM}$ is the offsetting moment due to the acceleration displaceable mass;

X is the distance (shown in FIG. 3) of the C.G offset;

$m_{DM}$ is the mass of the acceleration displaceable mass; and, g is gravity.

The offset distance X, in the case of the embodiment illustrated in FIG. 4, is related to the spring constant k:

$$X = \frac{m_{DM}\, a_{LA}}{k}$$

It is desirable to configure the acceleration displaceable placeable mass so that:

$$M_{LA} = M_{DM}$$

or

-continued $$Dm_l\, a_{LA} = \frac{m_{DM}\, a_{LA}}{k}\, m_{DM}\, g$$

or $$\frac{Dm_l}{g} = \frac{m_{DM}^2}{k}$$

This relationship should be useful in determining the spring constant and desired mass.

As the independent resonate frequency of the acceleration displaceable mass and spring combination is of importance, the general form of its calculation may be found by considering the following relationships:

$F = ma$ (force = mass times acceleration)

$$xk = m_{DM}\, a_{LA}$$

$$a_{LA} = \frac{k}{m_{DM}}\, X$$

$$w_{LA} = \sqrt{\frac{k}{m_{DM}}} \text{ Radians per second,}$$

$$f_{LA} = \frac{w_{LA}}{2\pi} \text{ hertz, or}$$

$$P = \frac{2\pi}{w_{LA}} \text{ seconds per period}$$

The INMARSAT specifications, and spefications for a particular antenna application, are of particular interest. For example, INMARSAT specifications provide that induced acceleration for above deck equipment should have maximum tangential accelerations of less than 0.5 g; must withstand roll motions having a period of 8 seconds, pitch motions having a period of 6 seconds, and yaw motions having a period of 50 seconds. Thus, in the INMARSAT specifications, the most rapid excitations are 1/(6 seconds), or 0.167 Hz.

If an antenna system, for example, has the following parameters:

Total weight, $W_{LA}$ = 220 lbs resting on gymbal $D$ = 0.4 inches $X$ = 6.0 inches maximum $3 f_x$ 50 Hz then we have:

$$\frac{m_{DM}^2}{k} = \frac{m_{LA} D}{g}$$

$$\frac{m_{DM}^2}{k} = \frac{\left(\frac{220}{32.2}\right)\left(\frac{0.4}{12}\right)}{32.2} = 7.0727 \times 10^{-3}$$

$$Xk = m_{DM}\, a_{LA}$$

$$k = \frac{m_{DM}\, a_{LA}}{X}$$

$$k = \frac{.5\,(32.2)}{.5}\, m_{DM} = 32.2\, m_{DM}$$

-continued

Thus, $$\frac{m_{DM}^2}{32.2\, m_{DM}} = 7.0727 \times 10^{-3}$$

$m_{DM}$ = 0.2277 slugs $W_{DM}$ = 7.33 lbs $$k = 32.2\, m_{DM} = 7.33\, \frac{\text{lbs}}{\text{ft.}}$$

$$w_{LA} = \sqrt{\frac{k}{m_{DM}}} \text{ Radians per sec.}$$

$$f_{LA} = \frac{w_{LA}}{2\pi}$$

$$f_{LA} = \sqrt{\frac{\frac{k}{m_{DM}}}{2\pi}} = \frac{\sqrt{32.2}}{2\pi}$$

$f_{LA}$ = 0.903 Hz, or $P$ = 1.107 sec. per period

These relationships and the example of their use may be useful in constructing a particular antenna pedestal having an acceleration displaceable mass.

The foregoing disclosure is of a presently preferred embodiment of the invention for purposes of teaching those skilled in the art how to make and use the invention. Further disclosure is contained in U.S. Pat. No. 3,893,123, entitled "Combination Gyro and Pendulum Weight Stabilized Platform Antenna System," by Albert H. Biesser; and U.S. Pat. No. 4,020,491, entitled "Combination Gyro and Pendulum Weight Passive Antenna Platform Stabilization System," by Albert H. Bieser, et al., both of which are incorporated herein by reference.

Those skilled in the art, after having the benefit of this disclosure of the invention, will undoubtably appreciate that many modifications may be made to the embodiment disclosed herein without departing from the spirit and scope of the invention. The scope of the invention shall not be limited to the embodiment illustrated herein, but shall include all modifications encompassed within the scope of the claims.

What is claimed is:

1. A stabilized platform for use in connection with a satellite antenna mounted to a ship, comprising:

a platform mounted on a gimbal joint which is adapted to be supported upon a ship;

the platform being mechanically coupled to an antenna such that stabilization of the platform will tend to stabilize the antenna and tend to maintain the pointing of the antenna generally in a fixed direction during pitch and roll motions of the ship;

an acceleration displaceable mass adapted to compensate for linear acceleration, the acceleration displaceable mass having an initial position in the absence of linear acceleration;

the platform, the acceleration displaceable mass, and the antenna forming a substantially balanced structure when the acceleration displaceable mass is in said initial position, the structure having a center of gravity located below the gimbal joint;

the acceleration displaceable mass being operable to reduce forces due to linear acceleration tending to destabilize the platform, the acceleration displaceable mass being operable to move to a displaced position, which is spaced from said initial position, in response to linear acceleration of the structure formed by the platform, the acceleration displaceable mass and the antenna, the acceleration displaceable mass being operable to generate an opposing torque when the acceleration displaceable mass moves to its displaced position such that the opposing torque tends to offset the destabilizing forces due to linear acceleration;

the acceleration displaceable mass including a pendulum supported by the platform, where the pendulum is operable to reduce destabilization of the platform caused by linear acceleration forces by moving to a displaced position in response to linear acceleration of the structure formed by the platform, the pendulum and the antenna, the pendulum being operable to generate an opposing torque when the pendulum moves to its displaced position such that the opposing torque tends to offset the destabilizing effects of linear acceleration, the pendulum being operable to return to an initial position when the platform is at rest; and, the pendulum having a weight "$W_a$" which is substantially equal to the product of the total weight of the structure supported upon the gimbal joint "$W_s$" times the offset "h" of the center of gravity of said structure, all divided by the length "o" of said pendulum.

2. The stabilized platform according to claim 1, further comprising:

a gyro, the gyro being mechanically coupled to the platform so that the gyro's resistance to displacement tends to stabilize the platform.

3. The stabilized platform according to claim 1, further comprising:

a first gyro, the first gyro being pivotably mounted upon an axis;

a second gyro, the second gyro being pivotably mounted upon an axis which is generally normal to the axis of the first gyro;

the first and second gyros being mechanically coupled to the platform such than the gyros tend to stabilize the platform.

4. The stabilized platform according to claim 3, wherein:

the axis of the first gyro is generally parallel to the plane of the platform; and, the axis of the second gyro is generally parallel to the plane of the platform.

5. The stabilized platform according to claim 1, wherein:

the offset "h" of the center of gravity of said structure is approximately 0.375 inch below the gimbal joint when the pendulum is in its initial position.

6. The stabilized platform according to claim 2, wherein:

the offset "h" of the center of gravity of said structure is approximately 0.375 inch below the gimbal joint when the pendulum is in its initial position.

7. The stabilized platform according to claim 3, wherein:

the offset "h" of the center of gravity of said structure is approximately 0.375 inch below the gimbal joint when the pendulum is in its initial position.

8. The stabilized platform according to claim 4, wherein:

the offset "h" of the center of gravity of said structure is approximately 0.375 inch below the gimbal joint when the pendulum is in its initial position.

9. The stabilized platform according to claim 1, wherein:

the length "o" of the pendulum is sufficiently short to give the pendulum a resonant frequency that is slightly below 3 Hz so that the pendulum will have a quick response time without being unduly responsive to vibrations.

10. The stabilized platform according to claim 5, wherein:

the length "o" of tbe pendulum is sufficiently short to give the pendulum a resonant frequency that is slightly below 3 Hz so that the pendulum will have a quick response time without being unduly responsive to vibrations.

11. The stabilized platform according to claim 6, wherein:

the length "o" of the pendulum is sufficiently short to give the pendulum a resonant frequency that is slightly below 3 Hz so that the pendulum will have a quick response time without being unduly responsive to vibrations.

12. The stabilized platform according to claim 7, wherein:

the length "o" of the pendulum is sufficiently short to give the pendulum a resonant frequency that is slightly below 3 Hz so that the pendulum will have a quick response time without being unduly responsive to vibrations.

13. The stabilized platform according to claim 8, wherein:

the length "o" of the pendulum is sufficiently short to give the pendulum a resonant frequency that is slightly below 3 Hz so that the pendulum will have a quick response time without being unduly responsive to vibrations.

14. The stabilized platform according to claim 1, wherein:

the offset "h" of the center of gravity of said structure is within the range of 0.1 to 0.8 inch, when said pendulum is in its initial position.

15. The stabilized platform according to claim 2, wherein:

the offset "h" of the center of gravity of said structure is within the range of 0.1 to 0.8 inch, when said pendulum is in its initial position.

16. The stabilized platform according to claim 3, wherein:

the offset "h" of the center of gravity of said structure is within the range of 0.1 to 0.8 inch, when said pendulum is in its initial position.

17. The stabilized platform according to claim 4, wherein:

the offset "h" of the center of gravity of said structure is within the range of 0.1 to 0.8 inch, when said pendulum is in its initial position.

18. The stabilized platform according to claim 9, wherein:

the offset "h" of the center of gravity of said structure is within the range of 0.1 to 0.8 inch, when said pendulum is in its initial position.

19. The stabilized platform according to claim 1, wherein:

a gyro mechanically coupled to the platform is provided so that the gyro's resistance to displacement tends to stabilize the platform; and the platform, antenna and gyro define a pendulous pedestal having a penduluous resonate frequency, the pendulous pedestal having a compound pendulum resonate frequency which is at least 10 times lower than the resonant frequency of the pendulum comprising the acceleration displaceable mass.

20. The stabilized platform according to claim 3, wherein:

the platform, antenna and gyro define a pendulous pedestal having a pendulous resonate frequency, the pendulous pedestal having a compound pendulum resonate frequency which is at least 10 times lower than the resonant frequency of the pendulum comprising the acceleration displaceable mass.

21. The stabilized platform according to claim 9, wherein:

a gyro mechanically coupled to the platform is provided so that the gyro's resistance to displacement tends to stabilize the platform; and the platform, antenna and gyro define a pendulous pedestal having a pendulous resonate frequency, the pendulous pedestal having a compound pendulum resonate frequency which is at least 10 times lower than the resonant frequency of the pendulum comprising the acceleration displaceable mass.

22. The stabilized platform according to claim 12, wherein:

the platform, antenna and gyro define a pendulous pedestal having a pendulous resonate frequency, the pendulous pedestal having a compound pendulum resonate frequency which is at least 10 times lower than the resonant frequency of the pendulum comprising the acceleration displaceable mass.

23. The stabilized platform according to claim 14, wherein:

a gyro mechanically coupled to the platform is provided so that the gyro's resistance to displacement tends to stabilize the platform; and the platform, antenna and gyro define a pendulous pedestal having a pendulous resonate frequency, the pendulous pedestal having a compound pendulum resonate frequency which is at least 10 times lower than the resonant frequency of the pendulum comprising the acceleration displaceable mass.

24. The stabilized platform according to claim 16, wherein:

the platform, antenna and gyro define a pendulous pestal having a pendulous resonate frequency, the pendulous pedestal having a compound pendulum resonate frequency which is at leat 10 times lower than the resonant frequency of the pendulum comprising the acceleration displaceable mass.

25. A stabilized platform for use in connection with a satellite antenna mounted to a ship, comprising:

a platform mounted on a gimbal joint which is adapted to be supported upon a ship;

the platform being mechanically coupled to an antenna such that stabilization of the platform will tend to stabilize the antenna and tend to maintain the pointing of the antenna generally in a fixed direction during pitch and roll motions of the ship;

an acceleration displaceable mass adapted to compensate for linear acceleration, the acceleration displaceable mass having an initial position in the absence of linear acceleration;

the platform, the acceleration displaceable mass, and the antenna forming a statically balanced structure when the accleration displaceable mass is in said initial positon, the structure having a center of gravity located below the gimbal joint;

the acceleration displaceable mass being operable to reduce forces due to linear acceleration tending to destabilize the platform, the acceleration displaceable mass being operable to move to a displaced position, which is spaced from said initial position, in response to linear acceleration of the structure formed by the platform, the accleration displaceable mass and the antenna, the acceleration displaceable mass being operable to ganerate an opposing torque when the acceleration displaceable mass moves to its displaced position such that the opposing torque tends to offset the destabilizing forces due to linear acceleration;

the acceleration displaceable mass including a pendulum supported by the platform, where the pendulum is operable to reduce destabilization of the platform caused by linear acceleration forces by moving to a displaced position in response to linear acceleration of the structure formed by the platform, the pendulum and the antenna, the pendulum being operable to generate an opposing torque when the pendulum moves to its displaced position such that the opposing torque tends to offset the destabilizing effects of linear acceleration, the pendulum being operable to return to an initial position when the platform is at rest; and, the pendulum having a weight "$W_a$" which is substantially equal to the product of the total weight of the structure supported upon the gimbal joint "$W_s$" times the offset "h" of the center of gravity of said structure, all divided by the length "o" of said pendulum.

26. The stabilized platform according to claim 25, further comprising:

a gyro, the gryo being mechanically coupled to the platform so that the gyro's resistance to displacement tends to stabilize the platform.

27. The stabilized platform according to claim 25, further comprising:

a first gyro, the first gyro being pivotably mounted upon an axis;

a second gyro, the second gyro being pivotably mounted upon an axis which is generally normal to the axis of the first gyro;

the first and second gyros being mechanically coupled to the platform such that the gyros tend to stabilize the platform.

28. The stabilized platform according to claim 27, wherein:

the axis of the first gyro is generally parallel to the plane of the platform; and, the axis of the second gyro is generally paralllel to the plane of the platform.

29. The stabilized platform according to claim 25, wherein:

the offset "h" of the center of gravity of said structure is approximately 0.375 inch below the gimbal joint when the pendulum is in its initial position.

30. The stabilized platform according to claim 26, wherein:

the offset "h" of the center of gravity of said structure is approximately 0.375 inch below the gimbal joint when the pendulum is in its initial position.

31. The stabilized platform according to claim 27, wherein:

the offset "h" of the center of gravity of said structure is approximately 0.375 inch below the gimbal joint when the pendulum is in its initial position.

32. The stabilized platform according to claim 28, wherein:

the offset "h" of the center of gravity of said structure is approximately 0.375 inch below the gimbal joint when the pendulum is in its initial position.

33. The stabilized platform according to claim 25, wherein:

the length "o" of the pendulum is sufficiently short to give the pendulum a resonant frequency that is slightly below 3 Hz so that the pendulum will have a quick response time without being unduly responsive to vibrations.

34. The stabilized platform according to claim 29, wherein:

the length "o" of the pendulum is sufficiently short to give the pendulum a resonant frequency that is slightly below 3 Hz so that the pendulum will have a quick response time without being unduly responsive to vibrations.

35. The stabilized platform according to claim 30, wherein:

the length "o" of the pendulum is sufficiently short to give the pendulum a resonant frequency that is slightly below 3 Hz so that the pendulum will have a quick response time without being unduly responsive to vibrations.

36. The stabilized platform according to claim 31, wherein:

the length "o" of the pendulum is sufficiently short to give the pendulum a resonant frequency that is slightly below 3 Hz so that the pendulum will have a quick response time without being unduly responsive to vibrations.

37. The stabilized platform according to claim 32, wherein:

the length "o" of the pendulum is sufficiently short to give the pendulum a resonant frequency that is slightly below 3 Hz so that the pendulum will have a quick response time without being unduly responsive to vibrations.

38. The stabilized platform according to claim 25, wherein:

the offset "h" of the center of gravity of said structure is within the range of 0.1 to 0.8 inch, when said pendulum is in its initial position.

39. The stabilized platform according to claim 26, wherein:

the offset "h" of the center of gravity of said structure is within the range of 0.1 to 0.8 inch, when said pendulum is in its initial position.

40. The stabilized platform according to claim 27, wherein:

the offset "h" of the center of gravity of said structure is within the range of 0.1 to 0.8 inch, when said pendulum is in its initial position.

41. The stabilized platform according to claim 28, wherein:

the offset "h" of the center of gravity of said structure is within the range of 0.1 to 0.8 inch, when said pendulum is in its initial position.

42. The stabilized platform according to claim 33, wherein:

the offset "h" of the center of gravity of said structure is within the range of 0.1 to 0.8 inch, when said pendulum is in its initial position.

43. The stabilized platform according to claim 25, wherein:

a gyro mechanically coupled to the platform is provided so that the gyro's resistance to displacement tends to stabilize the platform; and the platform, antenna and gyro define a pendulous pedestal having a pendulous resonate frequency, the pendulous pedestal having a compound pendulum resonate frequency which is at least 10 times lower than the resonant frequency of the pendulum comprising the acceleration displaceable mass.

44. The stabilized platform according to claim 27, wherein:

the platform, antenna and gyro define a pendulous pedestal having a pendulous resonate frequency, the pendulous pedestal having a compound pendulum resonate frequency which is at least 10 times lower than the resonant frequency of the pendulum comprising the acceleration displaceable mass.

45. The stabilized platform according to claim 33, wherein:

a gyro mechanically coupled to the platform is provided so that the gyro's resistance to displacement tends to stabilize the platform; and the platform, antenna and gyro define a pendulous pedestal having a pendulous resonate frequency, the pendulous pedestal having a compound pendulum resonate frequency which is at least 10 times lower than the resonant frequency of the pendulum comprising the acceleration displaceable mass.

46. The stabilized platform according to claim 36, wherein:

the platform, antenna and gyro define a pendulous pedestal having a pendulous resonate frequency, the pendulous pedestal having a compound pendulum resonate frequency which is at least 10 times lower than the resonant frequency of the pendulum comprising the acceleration displaceable mass.

47. The stabilized platform according to claim 38, wherein:

a gyro mechanically coupled to the platform is provided so that the gyro's resistance to displacement tends to stabilize the platform; and the platform, antenna and gyro define a pendulous pedestal having a pendulous resonate frequency, the pendulous pedestal having a compound pendulum resonate frequency which is at least 10 times lower than the resonant frequency of the pendulum comprising the acceleration displaceable mass.

48. The stabilized platform according to claim 40, wherein:

the platform, antenna and gyro define a pendulous pedestal having a pendulous resonate frequency, the pendulous pedestal having a compound pendulum resonate frequency which is at least 10 times lower than the resonant frequency of the pendulum comprising the acceleration displaceable mass.

49. The stabilized platform according to claim 42, wherein:

a gyro mechanically coupled to the platform is provided so that the gyro's resistance to displacement tends to stabilize the platform; and the platform, antenna and gyro define a pendulous pedestal having a pendulous resonate frequency, the pendulous pedestal having a compound pendulum resonate frequency which is at least 10 times lower than the resonant frequency of the pendulum comprising the acceleration displaceable mass.

* * * * *

UNITED STATES PATENT AND TRADEMARK OFFICE

CERTIFICATE OF CORRECTION

PATENT NO. : 4,596,989 Page 1 of 2

DATED : June 24, 1986

INVENTOR(S) : Dorsey T. Smith and Albert H. Bieser

It is certified that error appears in the above-identified patent and that said Letters Patent is hereby corrected as shown below:

Column 4, line 47, change "ship'compass." to -- ship's compass. --.

Column 13, line 61, change "$2/5M_A r^2$ X $M_A P^2$;" to --$2/5M_A r^2 + M_A P^2$; --.

Column 14, line 9, change "ange" to -- angle --; line 39, change "sin G-S" to -- sin (G-S) --.

Column 15, line 43, change "$-K(K_o \sin(T+S))_o$" to -- $-K(K_o \sin(T+S))K_o$ --; line 47, change "times The" to -- times the --.

Column 20, line 35, change "MLA=D $m_t a_{LA}$" to -- $M_{LA}$=D $m_t a_{LA}$ --.

Column 22, line 65, change "substantially" to -- statically --.

Column 23, line 46, change "such than" to -- such that --.

Column 24, line 15, change "tbe" to -- the --.

Column 25, line 51, change "pestal" to -- pedestal --.

UNITED STATES PATENT AND TRADEMARK OFFICE

CERTIFICATE OF CORRECTION

PATENT NO. : 4,596,989

DATED : June 24, 1986

INVENTOR(S) : Dorsey T. Smith and Albert H. Bieser

It is certified that error appears in the above-identified patent and that said Letters Patent is hereby corrected as shown below:

Column 26, line 3, change "accleration" to -- acceleration --; line 12, change "accleration" to -- acceleration --; line 14, change "ganerate" to -- generate --.

Signed and Sealed this

Twenty-first Day of October, 1986

[SEAL]

*Attest:*

DONALD J. QUIGG

*Attesting Officer*

*Commissioner of Patents and Trademarks*